US005425630A

United States Patent [19]

Dutescu et al.

[11] Patent Number: 5,425,630

[45] Date of Patent: Jun. 20, 1995

[54] KINETIC DISSOCIATOR

[76] Inventors: Cornel Dutescu, Binnenweg 18, 8075 CE Elspeet; Gilbert Versteeg, Stationslaan 55, 8071 CK Nunspeet, both of Netherlands

[21] Appl. No.: 147,989

[22] Filed: Nov. 4, 1993

[51] Int. Cl.[6] ..... F23D 14/00

[52] U.S. Cl. ..... 431/5; 431/9; 431/10; 431/350; 431/353

[58] Field of Search ..... 431/5, 9, 10, 115, 116, 431/350, 353, 202; 422/182, 183

[56] References Cited

U.S. PATENT DOCUMENTS

| | | | |
|---|---|---|---|
| 792,642 | 6/1905 | Williams . | |
| 871,070 | 11/1907 | Schwartz . | |
| 1,986,201 | 1/1935 | Huff | 158/117.5 |
| 2,167,444 | 7/1939 | Brace et al. | 158/5 |
| 2,172,260 | 9/1939 | Rees | 60/46 |
| 2,408,111 | 8/1946 | Truax et al. | 60/35.6 |
| 2,498,263 | 2/1950 | Goddard | 158/28 |
| 2,999,358 | 9/1961 | Zwick | 60/39.46 |
| 3,073,684 | 1/1963 | Williams, Sr. | 431/5 |
| 3,194,215 | 7/1965 | Barnes | 431/5 |
| 3,258,052 | 6/1966 | Wilson et al. | 158/1 |
| 3,266,480 | 8/1966 | Miller et al. | 126/109 |
| 3,607,119 | 9/1971 | Nesbitt | 431/5 |
| 4,000,978 | 1/1977 | Henrie | 23/277 |
| 4,022,163 | 5/1977 | Baumgartner et al. | 122/225 |
| 4,682,578 | 7/1987 | Schmidt | 126/91 |
| 4,708,637 | 11/1987 | Dutescu | 431/116 |
| 4,820,500 | 4/1989 | Obermuller | 431/5 |
| 4,971,550 | 11/1990 | Schingnitz et al. | 431/143 |
| 5,269,679 | 10/1993 | Syska et al. | 431/9 |

FOREIGN PATENT DOCUMENTS

| | | |
|---|---|---|
| 2353115 | 5/1974 | Germany . |

*Primary Examiner*—James C. Yeung
*Attorney, Agent, or Firm*—Arnold, White & Durkee

[57] ABSTRACT

A kinetic dissociator is formed by a primary combustion chamber and a secondary combustion chamber. The primary and secondary combustion chambers are connected by at least one flow stabilization tube. A source of high temperature, high velocity gas is provided by at least one high speed combustion jet axially aligned with the flow stabilization tube such that the jet gas mixes with a process gas passes through the tube and impinges against a conically shaped wall forming a portion of the secondary combustion chamber.

14 Claims, 1 Drawing Sheet

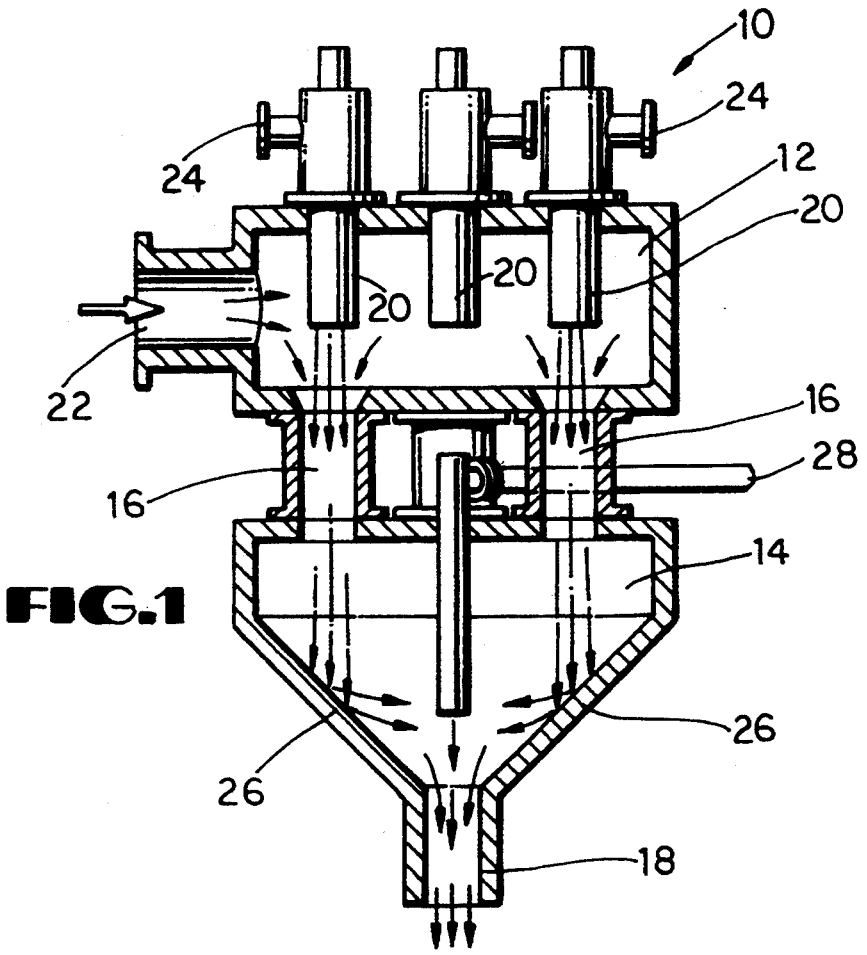
FIG.1
FIG.2
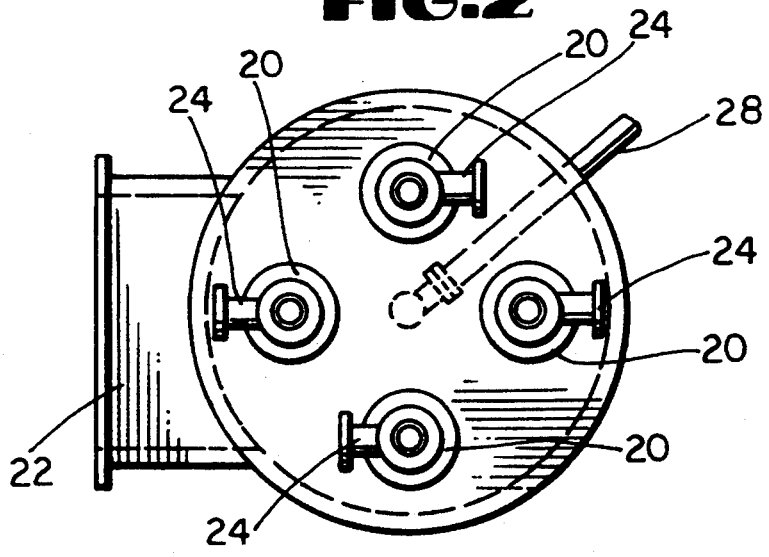

KINETIC DISSOCIATOR

BACKGROUND

The present invention relates to reactors for combusting gaseous fuels. More particularly, the invention relates to a kinetic dissociator in which process gases are completely reacted prior to discharge.

A kinetic dissociator is a thermal reactor that creates the proper conditions for fuel elements to fully react with oxygen, thus releasing the total amount of the free energies expected from any and all of the thermodynamic chemical reactions of combustion. Such an apparatus will prevent the emission of products of imperfect combustion like carbon monoxide, hydrocarbons, carbon molecules and free sulfur.

Combustors and combustion reactors that burn fuel elements completely, release only carbon dioxide and water into the atmosphere when burning clean hydrocarbon fuels. Usually these combustors are used for processes where perfect combustion is desired because of economical reasons such as lower energy costs. However, large portions of the heat processing and heat user industry do not have processes that discharge clean emissions as they use old combustion technologies or they burn fuel that is not clean or too complex to be burned in one stage.

A typical industry that discharges pollutants from combustion processes into the atmosphere is the incineration industry. Most of the incinerators burn solid, liquid or gaseous waste of complex molecular structures. The emissions contain pollutants like carbon monoxide, nitrogen oxides, carbon dust, hydrocarbons and substituted hydrocarbon compounds such as chlorinated aromatics.

The presence of carbon monoxide in the products from a reactor is the first indication of the presence of the more dangerous emissions in flue gases. Carbon monoxide presence in the flue gas is an indication that the hydrocarbon molecules have not dissociated and reacted with oxygen completely since the reaction of oxygen and carbon monoxide to form carbon dioxide is a priority reaction. In other words, carbon monoxide is still being formed rather then being completely combusted.

In order to obtain perfect combustion of any fuel, the following conditions need to exist inside a combustion chamber or reactor; required molar masses of fuel and oxygen, proper temperature, proper molecular speed, proper particle residence time (reaction time) and constant pressure. If any one of these conditions is not present, the combustion will be imperfect and the emissions will contain pollutants.

In order to prevent pollutant discharge into the atmosphere from an imperfect combustion chamber, flue gases are often passed through a second stage combustor that offers new and better combustion reaction conditions. Secondary combustors are often called "afterburners" and usually consist of just an additional burner installed in an exit tunnel such as the gas passage to the flue.

An afterburner usually improves the overall combustion efficiency and occasionally qualifies a system to pass the pollution emissions requirements tests depending on the nature of the fuel and the geographical location of the system installation. However, if the pollution emission standards are very stringent or if the flue gas volume is large and not uniform in cross section composition and velocity, an afterburner in the tunnel without more will not be sufficient to solve the pollution problems.

Additionally, large flows of gases containing small amounts of carbon monoxide and hydrocarbons need to be remixed thoroughly and exposed to proper reaction conditions. This can be achieved only inside a well controlled reactor chamber.

In view of the foregoing, it is apparent that it would be an advancement in the art to provide a reaction chamber in which proper reaction conditions can more easily be maintained to completely react pollutants. Such a chamber is disclosed and claimed herein.

SUMMARY OF THE INVENTION

The present invention provides a kinetic dissociator for the complete combustion of gaseous fuels. It can be used with any type of process gas and is useful in eliminating pollutants in the form of large hydrocarbon molecules.

The invention typically comprises a primary combustion chamber and a secondary combustion chamber. The primary and secondary combustion chambers are connected by at least one flow stabilizer tube. A high temperature, high velocity first gas is introduced into the primary combustion chamber by at least one high speed combustion jet in axial alignment with a flow stabilizer tube. Typically, the source of the high temperature, high velocity gas is a gaseous fuel reactor such as is disclosed in U.S. Pat. No. 4,708,637. A second gas, containing compounds or pollutants to be reacted, is introduced into the primary combustion chamber through at least one inlet.

The second gas is inspirated by and mixed with the high temperature, high velocity first gas from the high speed combustion jets. The inspirating causes the second gas to accelerate to high speeds through the flow stabilizer tubes. The inspirated gas mixture exits the flow stabilizer tubes into the secondary combustion chamber and impacts on a conical shaped wall forming a portion of the secondary combustion chamber. The inside of the secondary combustion chamber is typically lined with a refractory material. At least one outlet for removing reacted products from the secondary combustion chamber is also provided.

In order to obtain complete combustion (or reaction) of the inlet gases, it is important to accurately maintain the temperature in the combustion chambers. The temperature control may be provided by a set point controller that operates a gas valve that can open and close in less than a second.

BRIEF DESCRIPTION OF THE DRAWINGS

FIG. 1 is a cross-sectional view of a preferred embodiment of the kinetic dissociator of the present invention.

FIG. 2 is a top view of a preferred embodiment of the kinetic dissociator of the present invention.

DETAILED DESCRIPTION OF THE PREFERRED EMBODIMENTS

The present invention is a kinetic dissociator that provides complete combustion of process gases prior to their discharge into the atmosphere. The dissociator can be used with essentially any type of contaminated process gas such as that produced by incinerators and tire, aces. It is especially effective in combusting pollutants that contain large molecules that come from paper, wood and plastics such as cellulose and aromatic hydrocarbons. The invention is best understood by reference to the accompanying drawing in which like parts are designated with like numerals.

Referring to FIG. 1, a preferred embodiment of the dissociator of the present invention is generally designated at 10. The dissociator 10 is typically constructed of metal lined with a high density refractory material such as plastic mass refractories containing a high percentage of pure alumina and coaline with a calcium oxide content less than 0.1 percent. The materials are required to withstand temperatures of up to 2950° F. Dissociator 10 includes a primary combustion chamber 12 and a secondary combustion chamber 14. The primary combustion chamber 12 and secondary combustion chamber 14 are connected by four flow stabilization tubes 16. In this embodiment, the primary combustion chamber 12 is generally cylindrical in shape and the secondary combustion chamber 14 is generally conically-shaped with at least one outlet 18 for discharging reaction products.

A high temperature, high velocity first gas is introduced into the primary combustion chamber 12 by four high speed combustion jets 20. The velocity of the first gas will typically approach reach one. The high temperature, high velocity first gas generally contains only products of near perfect combustion, $CO_2$ and $H_2O$, mixed with oxygen and nitrogen. A support fuel typically used by the combustion jets is methane. The high speed combustion jets 20 in the preferred embodiment comprise gaseous fuel reactors such as are disclosed in U.S. Pat. No. 4,708,637, the teachings of which are hereby incorporated by reference. The high speed combustion jets 20 are axially aligned with the flow stabilization tubes 16. The high speed combustion jets 20 also comprise an inlet 24 for a source of free oxygen such as air.

While the preferred embodiment is illustrated with four flow stabilization tubes and four high speed combustion jets, that number is not critical. The number of tubes and jets depends on the amount of process gas to be treated and is generally between one and eight.

A second gas enters into the primary combustion chamber through an inlet 22. The second gas is a process gas containing large hydrocarbon molecular pollutants and particulates such as cellulose and aromatics. The inlet 22 is typically in the sidewall of the primary combustion chamber 12. The process gas enters into the primary combustion chamber 12 through inlet 22 at a relatively low velocity corresponding to the stack gas velocity, generally about 50 feet per second.

In operation, the high speed combustion jets 20 discharge high temperature, high velocity jets of gases into the primary combustion chamber 12. The high velocity jets mix with the process gas entering through inlet 22 in the sidewall of the primary combustion chamber 12. The high velocity jets add a momentum vector to the process gas towards the flow stabilization tubes 16 creating a mixed gas with a resultant flow of higher velocity and higher kinetic energy value than the process gas originally had. The high speed combustion jets 20 are axially aligned with the flow stabilization tubes 16 thereby directing the mixed gas molecules into the flow stabilization tubes 16. The relative diameters of the flow stabilization tubes 16 and high speed combustion jets 20 are calculated by employing venturi and pressure difference laws depending on the required gas velocities.

During travel through the flow stabilization tubes 16, the process gas molecules gain additional temperature and velocity, thereby increasing in kinetic energy. The mixed gas molecules then exit the flow stabilization tubes 16 as new, high momentum jets into the secondary combustion chamber 14 at a high resultant velocity. The temperature in the secondary combustion chamber 14 is typically between 2200° F. and 2400° F. The mixed gas molecules will then impact on a conically shaped wall 26 forming a portion of the inside of the secondary combustion chamber 14. The portion of the conically shaped wall 26 located in the path of the flow stabilization tubes 16 provides an impact zone. The area enclosed by the conically shaped wall 26 of the secondary combustion chamber 14 provides a reaction zone for the mixed gas molecules.

At the impact zone and in its vicinity, the gas molecules will mix very well. Also, at the moment of impact, the larger molecules will undergo atomic dissociation (or cracking) whereby they are broken down into smaller units which can more easily combust with available free oxygen. At impact time, the molecules will have velocities equal to about zero. The velocities of the molecules are then increased again until they reach exit velocity, which is typically between 200 ft/sec. and 600 ft/sec., thus allowing the ignition gas velocities to be reached for all elements inside the secondary combustion chamber 14. Therefore, oxidation of all hydrocarbon atoms will generally occur. Depending upon the quantity and quality of the contaminants in the process gas, it may be necessary for the exiting gas to enter an additional reaction chamber, such as an additional secondary combustion chamber in series, where reaction velocities and additional residence time are provided for complete oxidation. The additional residence time allows the gas molecules to gain additional heat energy, which in turn, produces additional atomic dissociation of the molecules.

The operating static pressure of the kinetic dissociator is typically under one pound per square inch. The temperature control is typically provided by thermocouples and a set point controller that operates a gas valve that can open and close in a fraction of a second. Also, tertiary air may be provided by an air injector 28 if additional oxygen is needed in the system.

As can be seen from the foregoing, the present invention provides a novel kinetic dissociator for obtaining complete combustion of gaseous reactants.

While the present invention has been described with reference to the presently preferred embodiment, it will be appreciated that the invention may be embodied in other specific forms without departing from its spirit or essential characteristics. Accordingly, the described embodiment is to be considered in all respects only as illustrative and not restrictive. The scope of the invention is, therefore, indicated by the appended claims rather than by the foregoing description. All modifications or changes which come within the meaning and range of equivalency of the claims are to be embraced within their scope.

We claim:

1. A kinetic dissociator, comprising:

a primary combustion chamber and a secondary combustion chamber, said combustion chamber having an impact zone and a reaction zone; a plurality of flow stabilizer tubes connecting said primary combustion chamber to said secondary combustion chamber;

a plurality of high speed combustion jets for introducing a high temperature, high velocity first gas into said primary combustion chamber, said jets being axially aligned with said stabilizer tubes;

at least one inlet for introducing a second gas into the primary combustion chamber, said second gas containing compounds to be reacted; and at least one outlet for removing reacted products from said secondary combustion chamber.

2. A kinetic dissociator as defined in claim 1 wherein said second gas contains large hydrocarbon molecules.

3. A kinetic dissociator as defined in claim 2 wherein said molecules are cellulose.

4. A kinetic dissociator as defined in claim 2 wherein said molecules are aromatics.

5. A kinetic dissociator as defined in claim 1 whereto said high temperature, high velocity gas contains oxygen and has a velocity of about mach one.

6. A kinetic dissociator as defined in claim 1 wherein a source of said high temperature, high velocity first gas comprises a gaseous fuel reactor.

7. A kinetic dissociator as defined in claim 1 wherein said primary combustion chamber is cylindrically shaped.

8. A kinetic dissociator as defined in claim 1 wherein said impact zone is formed from a portion of a conical shaped wall of said secondary combustion chamber.

9. A kinetic dissociator as defined in claim 1 wherein said dissociator includes from one to eight flow stabilizer tubes located at spaced apart intervals with a high speed combustion jet axially aligned with each flow stabilizer tube.

10. A kinetic dissociator as defined in claim 9 wherein said dissociator includes four flow stabilizer tubes located at spaced apart intervals and are aligned with four high speed combustion jets.

11. A kinetic dissociator of claim 1 wherein said primary combustion chamber, said flow stabilizer tubes and said secondary combustion chamber are formed from a metal lined with a high density refractory material.

12. A kinetic dissociator, comprising:

a primary combustion chamber and a secondary combustion chamber;

said secondary combustion chamber having an impact zone formed by a portion of a surface of a conical shaped wall, said secondary combustion chamber also having an enclosed reaction zone formed by walls of said chamber;

four high speed combustion jets for introducing a high temperature, high velocity first gas containing oxygen into said primary combustion chamber;

at least one inlet for introducing a second gas into said primary combustion chamber, said second gas containing pollutant compounds to be reacted;

four flow stabilizer tubes connecting said primary combustion chamber to said secondary combustion chamber, said flow stabilizer tubes being axially aligned with said high speed combustion jets;

at least one outlet for removing reacted products from said secondary combustion chamber.

13. A process for combusting gaseous fuels comprising the steps of:

providing a primary combustion chamber and a secondary combustion chamber, said secondary combustion chamber having a reaction zone and a conical impact zone;

providing a plurality of high speed combustion jets for introducing a high temperature, high velocity first gas into said primary combustion chamber;

providing at least one inlet introducing a second gas into the primary combustion chamber, said second gas containing compounds to be reacted;

providing a plurality of flow stabilizer tubes connecting said primary combustion chamber to said secondary combustion chamber, said flow stabilizer tubes being axially aligned with said high speed combustion jets;

inspirating said second gas in said primary combustion chamber through said flow stabilizer tubes and impacting said second gas onto said conical impact zone of said secondary combustion chamber;

maintaining the temperature and residence time in said secondary combustion chamber at sufficient levels to completely react said second gas with said first gas; and providing at least one outlet for discharging the reaction products.

14. A kinetic dissociator, comprising:

a primary combustion chamber and a secondary combustion chamber, said secondary combustion chamber having an impact zone and a reaction zone;

at least one flow stabilizer tube connecting said primary combustion chamber to said secondary combustion chamber;

at least one high speed combustion jet for introducing a high temperature first gas at a velocity at least about mach one into said primary combustion chamber, said jet being axially aligned with said stabilizer tube, and wherein temperature in said secondary combustion chamber is maintained at least at about 2200° F.;

at least one inlet for introducing a second gas into the primary combustion chamber, said second gas containing compounds to be reacted; and at least one outlet for removing reacted products from said secondary combustion chamber.

* * * * *

UNITED STATES PATENT AND TRADEMARK OFFICE
CERTIFICATE OF CORRECTION

Patent No.: 5,425,630

Dated: June 20, 1995

Inventors: Cornel Dutescu and Gilbert Versteeg

It is certified that error appears in the above-identified patent and that said Letters Patent is hereby corrected as shown below:

In column 2 line 67, "tire" should be --furnaces--.

In column 2, line 68, delete "aces."

In column 3, line 26, "reach" should be --mach--.

In column 5 (claim 5), line 17, "whereto" should be --wherein--.

Signed and Sealed this

Fifth Day of September, 1995

*Attest:*

*Attesting Officer*

BRUCE LEHMAN

*Commissioner of Patents and Trademarks*